US006012843A

United States Patent [19]

Brooks et al.

[11] Patent Number: 6,012,843

[45] Date of Patent: Jan. 11, 2000

[54] RECYCLE PLASTIC BAG HOLDER

[76] Inventors: Catherine Brooks, 2610 Mistletoe, New Orleans, La. 70118; Robert L. Jones, P.O. Box 15057, New Orleans, La. 70175

[21] Appl. No.: 09/087,579

[22] Filed: May 29, 1998

Related U.S. Application Data

[60] Provisional application No. 60/047,924, May 29, 1997.

[51] Int. Cl.[7] ..... B65D 33/25

[52] U.S. Cl. ..... 383/37; 383/24; 383/41

[58] Field of Search ..... 383/4, 41, 24, 383/66, 71, 67, 37, 22

[56] References Cited

U.S. PATENT DOCUMENTS

| | | | |
|---|---|---|---|
| 1,269,276 | 6/1918 | Harris | 383/4 |
| 1,370,248 | 3/1921 | White | 383/41 |
| 5,341,933 | 8/1994 | Willows | 383/41 X |
| 5,451,108 | 9/1995 | Anderson | 383/41 X |
| 5,692,836 | 12/1997 | Mitchell | 383/41 X |

FOREIGN PATENT DOCUMENTS

| | | | |
|---|---|---|---|
| 261427 | 2/1927 | United Kingdom | 383/16 |
| 2268157 | 1/1994 | United Kingdom | 383/41 |

*Primary Examiner*—Jes F. Pascua

*Attorney, Agent, or Firm*—Garvey, Smith, Nehrbass & Doody, L.L.C.

[57] ABSTRACT

Apparatus for holding plastic bags includes a fabric tube having an open top and an open bottom of reduced diameter, and a loop for hanging the fabric tube.

1 Claim, 2 Drawing Sheets

RECYCLE PLASTIC BAG HOLDER

CROSS-REFERENCE TO RELATED APPLICATIONS

Priority of U.S. Provisional Patent Application Ser. No. 60/047,924, filed May 29, 1997, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to plastic bags. More particularly, the present invention relates to holders to facilitate recycling of plastic grocery bags.

2. General Background of the Invention

Plastic grocery bags have become common lately. Unless one throws them away regularly, they quickly accumulate in a closet or cupboard.

The following U.S. Patents are incorporated herein by reference: U.S. Pat. Nos. 2,326,422; 2,865,418; 3,657,741; 4,856,112; 5,285,927; 5,341,933; 5,451,108; and 5,628,062.

BRIEF SUMMARY OF THE INVENTION

The apparatus of the present invention solves the problems confronted in the art in a simple and straightforward manner. What is provided is a holder for holding plastic bags, such as plastic grocery bags. The present invention is an attractive solution to the problem of storing plastic grocery bags.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
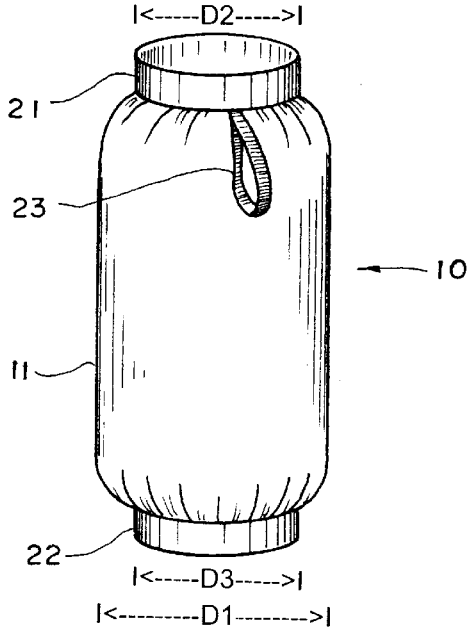
FIG. 1 is a perspective view of the preferred embodiment of the apparatus of the present invention.

FIG. 1 is a perspective view showing the preferred embodiment of the present invention, bag holder 10.

Figure 2:
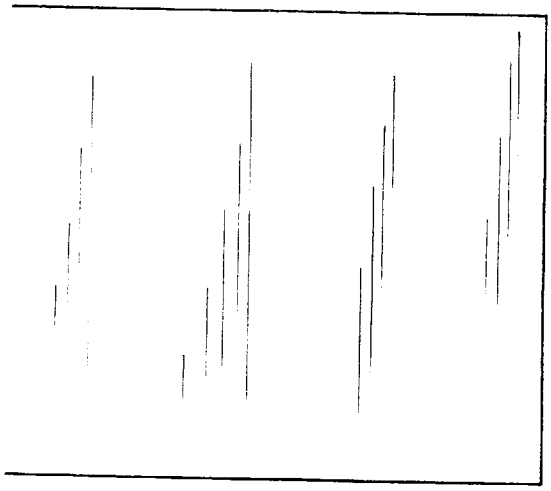
FIG. 2 is a plan view of the fabric used to make the preferred embodiment of the apparatus of the present invention.
Figure 3:
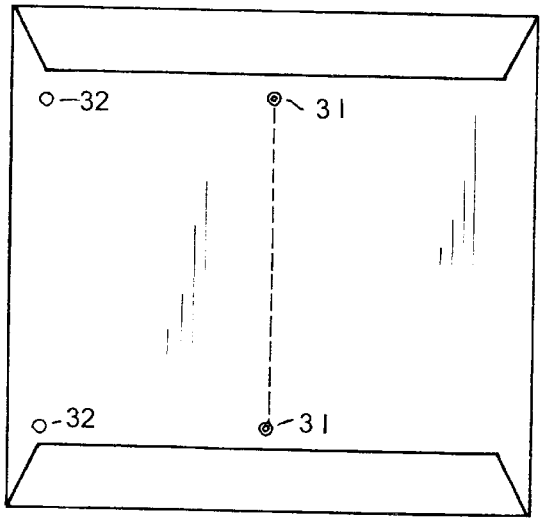
FIG. 3 is a plan view of a step in the construction of an alternative embodiment of the apparatus of the present invention.
Figure 4:
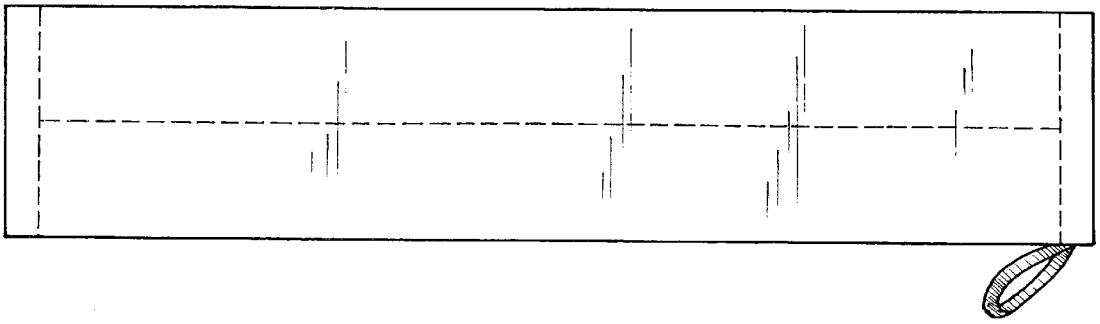
FIG. 4 is a plan view of a large embodiment of the apparatus of the present invention.
Figure 5:
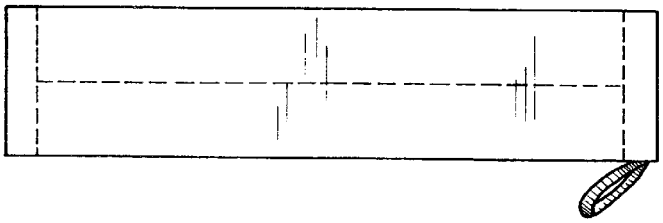
FIG. 5 is a plan view of a small embodiment of the apparatus of the present invention.
Figure 6:
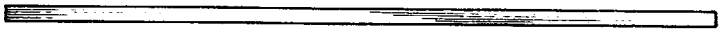
FIG. 6 shows the optional elastic for the apparatus shown in FIG. 4.
Figure 7:
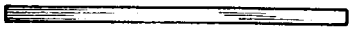
FIG. 7 shows the optional elastic for the apparatus shown in FIG. 5.
Figure 8:
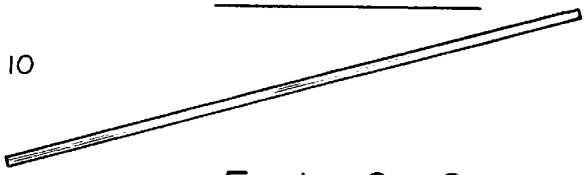
FIG. 8 shows the bias for the apparatus shown in FIG. 4.
Figure 9:
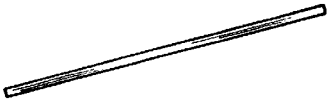
FIG. 9 shows the bias for the apparatus shown in FIG. 5.

FIGS. 2 and 3 show steps in the construction of the holder 10 the present invention. A piece of fabric (¼ of a yard, 45" wide) is formed, as by cutting out of a larger piece of fabric. The fabric can be cotton, for example. The back sides of the fabric are folded together, each forming a (for example, ⅝") hem. The bias (for example, #201 bias 3" long) is folded and sewn into one end of the seam. A hem (for example, ¼") is formed in the upper end of the fabric and in the lower end of the fabric, leaving an opening for the optional elastic material (having a width of, for example, 1"). Optionally, elastic material (for example, 13" or 15" long) is inserted into each seam, and one back stitches over hems and the bias.

The holder 10 described in the preceding paragraph can hold 30–40 standard plastic grocery bags, for example.

The holder 10 can be made larger to hold more bags, as, for example, doubling the size of the fabric (½ yard and 45" wide), using 15" long elastic (if elastic is used), and a 5" long #201 bias, for example.

The piece of fabric can instead be, for example, knit or permanent press (a cotton/polyester blend), but is preferably cotton.

The piece of fabric has a width of preferably 9–36 inches, and 9" or 18", for example.

The length of the piece of fabric is preferably 15–30 inches, and 17", 18", 26.5", or 29.75", for example.

The holder can have a diameter of preferably 5.5"–13", and 6.5" or 10.5", for example.

The unfolded bias length is preferably 1–8", and 3" or 5", for example.

The width of the optional elastic is preferably 0.75"–2", and ¾" or 1", for example.

The length of the optional elastic is preferably 2–17 inches, and 13" or 15", for example.

Plastic materials are generally not preferred for the fabric, as the plastic bags would tend to stick to them.

Metal snaps 31, 32 may optionally be included, as shown in FIG. 3. These snaps 31, 32 are used to close the openings 21, 22 to help prevent items from falling out of the holder 10, especially when the holder 10 is used as a lingerie laundry bag or is used for shoe storage in luggage.

Figure 10:
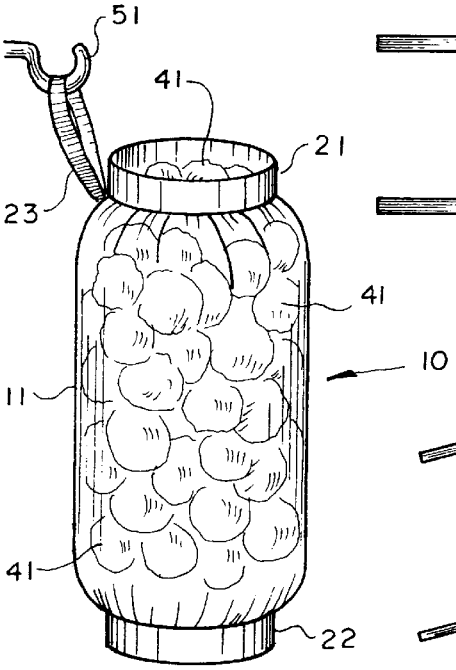
FIG. 10 shows the apparatus of the present invention hung on a hook and filled with plastic bags.

The bag holder 10 of the present invention can be hung on a look 51, as shown in FIG. 10, then filled with plastic bags (usually by inserting them into the open top 21). Plastic bags can then be removed from the open bottom 22.

With the holder 10 of the present invention, bags will be stored away from children, reducing the likelihood of accidental suffocation.

The holder 10 of the present invention can also be used as lingerie laundry bag (the whole bag can be dropped in a washing machine—in such a case, the holder preferably includes the optional snaps 31, 32 shown in the drawings). The holder 10 can also be used for shoe storage in luggage.

The bag holders 10 of the present invention need not have elastic at their openings—instead, the openings 21, 22 could simply be made smaller than the rest of the bag holder 10 (as shown in FIG. 10, for example) and the bags 41 would frictionally engage one another and the sides of the bag holder 10 so that the bags 41 would not fall out through the bottom opening 22 unless pulled therethrough. This embodiment, without elastic or other means to render the openings elastically stretchable, is actually preferred, because it is easier to make and less expensive.

As shown in FIGS. 1 and 10, bag holder 10 includes a fabric tube 11 having a diameter D1, an open top 21, and an open bottom 22. A loop 23 is provided to allow the holder to be hung on a hook (such as hook 51 shown in FIG. 10). The diameter D1 of tube 11 is preferably greater than the diameter D2 of open top 21 and is preferably greater than the diameter D3 of open bottom 22. Optional male snaps 31 and female snaps 32 allow the holder 10 to be closed easily. Holder 10 can be filled with plastic grocery bags 41, as shown in FIG. 10, and bags 41 can easily be withdrawn from the open top 21 or open bottom 22 of the holder 10.

Parts List:

10 bag holder
11 tube
21 open top
22 open bottom
23 loop
31 male snap fasteners
32 female snap fasteners
41 plastic grocery bags
51 hook
D1 diameter of tube 11
D2 diameter of open top 21
D3 diameter of open bottom 22

All measurements disclosed herein are at standard temperature and pressure, at sea level on Earth, unless indicated otherwise.

The foregoing embodiments are presented by way of example only; the scope of the present invention is to be limited only by the following claims.

We claim:

1. Apparatus including a plurality of plastic bags and a holder therefor, the plurality of plastic bags being in the holder, the holder comprising:

a fabric tube having an open top and an open bottom, the tube having a first diameter between the open top and open bottom, the open top having a second diameter, the open bottom having a third diameter, the first diameter being larger than the second diameter and the third diameter; means for hanging the fabric tube, wherein:

the open top and open bottom are not elastically stretchable, the open top and open bottom contain no elastic, and further comprising snap fasteners adjacent the open top and snap fasteners adjacent the open bottom for closing the holder.

* * * * *